US011835066B2

(12) United States Patent
Zhang et al.

(10) Patent No.: US 11,835,066 B2
(45) Date of Patent: Dec. 5, 2023

(54) CEILING FAN AND ASSEMBLING STRUCTURE OF CEILING FAN

(71) Applicant: FOSHAN CARRO ELECTRICAL CO., LTD., Foshan (CN)

(72) Inventors: Jian-Sheng Zhang, Foshan (CN); Zhi-Qiang Yuan, Foshan (CN)

(73) Assignee: Foshan Carro Electrical Co., Ltd., Foshan (CN)

( * ) Notice: Subject to any disclaimer, the term of this patent is extended or adjusted under 35 U.S.C. 154(b) by 10 days.

(21) Appl. No.: 17/654,656

(22) Filed: Mar. 14, 2022

(65) Prior Publication Data

US 2023/0120958 A1 Apr. 20, 2023

(30) Foreign Application Priority Data

Oct. 18, 2021 (CN) ..... 202122499743.6

(51) Int. Cl.
*F04D 29/66* (2006.01)
*F04D 19/00* (2006.01)
*F04D 29/64* (2006.01)

(52) U.S. Cl.
CPC ..... *F04D 29/668* (2013.01); *F04D 19/002* (2013.01); *F04D 29/644* (2013.01)

(58) Field of Classification Search
CPC .... F04D 29/668; F04D 19/002; F04D 29/644; F04D 29/646; F04D 25/088
See application file for complete search history.

(56) References Cited

U.S. PATENT DOCUMENTS

| | | | | |
|---|---|---|---|---|
| 11,649,831 | B2 * | 5/2023 | Mason | F04D 29/325 417/410.1 |
| 2016/0211728 | A1 * | 7/2016 | Yin | H02K 5/04 |
| 2020/0400162 | A1 * | 12/2020 | He | H02K 7/14 |
| 2021/0048032 | A1 * | 2/2021 | Bae | F04D 29/38 |
| 2021/0180602 | A1 * | 6/2021 | Aynsley | F04D 29/601 |
| 2022/0145895 | A1 * | 5/2022 | Yao | F04D 25/0693 |
| 2022/0235782 | A1 * | 7/2022 | Villella | F04D 25/06 |
| 2022/0409762 | A1 * | 12/2022 | Wald | A61L 9/20 |
| 2023/0120958 | A1 * | 4/2023 | Zhang | F04D 25/088 416/244 R |
| 2023/0124912 | A1 * | 4/2023 | Wu | F04D 25/088 362/96 |
| 2023/0143101 | A1 * | 5/2023 | Harris | F04D 29/384 416/210 R |

* cited by examiner

*Primary Examiner* — Aaron R Eastman
(74) *Attorney, Agent, or Firm* — Rosenberg, Klein & Lee

(57) ABSTRACT

An assembling structure of a ceiling fan has a motor shaft and a driving assembly mounted on the motor shaft. The motor shaft is mounted through the driving assembly. The driving assembly has an upper cover, a lower cover, a chamber, a circuit board, and a positioning mechanism. The lower cover has a covering board and a mounting cylinder mounted in a center of the covering board, and is mounted on the motor shaft via the mounting cylinder. The chamber is formed between the upper cover and the lower cover. The circuit board is mounted in the chamber. The upper cover, the lower cover, and the circuit board are sequentially arranged from top to bottom. The positioning mechanism is mounted in the chamber and limits a mounting position of the circuit board. The present invention solves the noise issue.

16 Claims, 5 Drawing Sheets

CEILING FAN AND ASSEMBLING STRUCTURE OF CEILING FAN

BACKGROUND OF THE INVENTION

1. Field of the Invention

The present invention relates to household appliances, especially to a ceiling fan and an assembling structure of the ceiling fan.

2. Description of the Prior Arts

A ceiling fan is an electric fan that is fixed on the ceiling. The ceiling fan is energy saving, convenient, and practical, therefore being popular with consumers. With the continuous improvement of people's living quality, how to improve the user experience of ceiling fans becomes a main subject for most ceiling fan manufacturers.

In a conventional ceiling fan, the fan blades are fixed on an end of the mounting base by a screw and the other end of the mounting base is fixed on the rotor of the motor by another screw. Therefore, the conventional ceiling fan is prone to shaking due to the rotation of the fan blades, and during operation the other components and structures except the fan blades are prone to loosening and making noises, which results in a poor user experience.

To overcome the shortcomings, the present invention provides a ceiling fan and an assembling structure of the ceiling fan to mitigate or obviate the aforementioned problems.

SUMMARY OF THE INVENTION

The main objective of the present invention is to provide a ceiling fan and an assembling structure of the ceiling fan that improves the stability of the driving device, solves the noise issue caused by the loosened parts and the shaking generated by the fan blades, and has a simplified structure that facilitates ease in installation.

The assembling structure has a motor shaft and a driving assembly. The driving assembly is mounted on the motor shaft. The motor shaft is mounted through the driving assembly. The driving assembly has an upper cover, a lower cover, a chamber, a circuit board, and a positioning mechanism. The lower cover has a covering board and a mounting cylinder. The mounting cylinder is mounted in a center of the covering board. The lower cover is mounted on the motor shaft via the mounting cylinder. The chamber is formed between the upper cover and the lower cover. The circuit board is mounted in the chamber. The upper cover, the lower cover, and the circuit board sequentially are arranged from top to bottom. The positioning mechanism is mounted in the chamber and limits a mounting position of the circuit board.

The present invention has the following advantages:

1. The configuration of the mounting cylinder increases the contact area of the lower cover and the motor shaft, thereby enhancing the structural strength of the lower cover and the motor shaft and further improving the structural stability of the driving assembly and the motor shaft. Thus, the present invention solves the noise issue caused by the loosened parts and the shaking generated by the fan blades, and having a simplified and reliable structure.

2. The driving assembly has the positioning mechanism mounted in the chamber formed between the upper cover and the lower cover and adapted to limit the mounting position of the circuit board in the chamber, so the circuit board can be stably mounted in the chamber to further reduce the noises during operating, which offers a better user experience.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
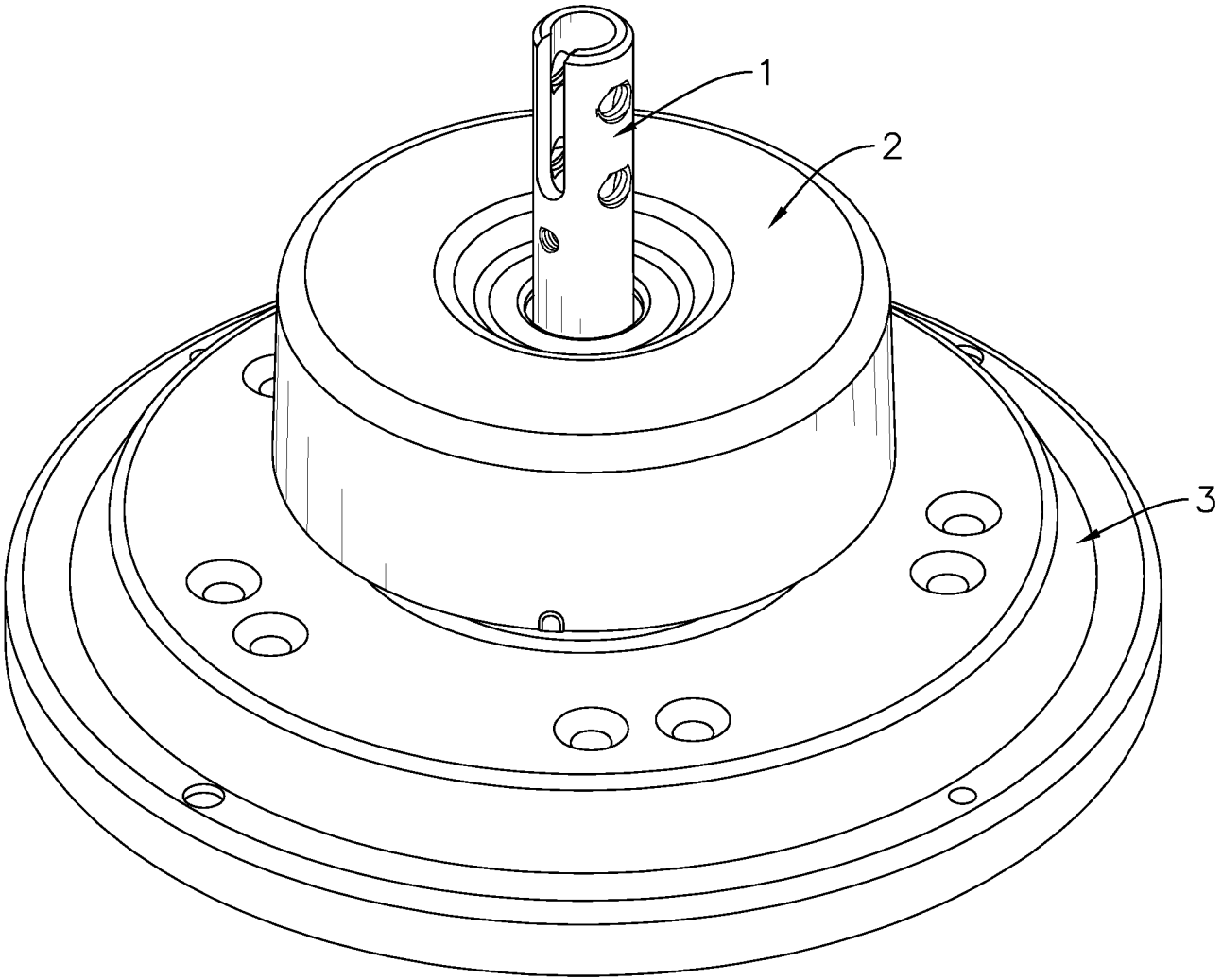
FIG. 1 is a perspective view of an assembling structure of a ceiling fan in accordance with the present invention.
Figure 2:
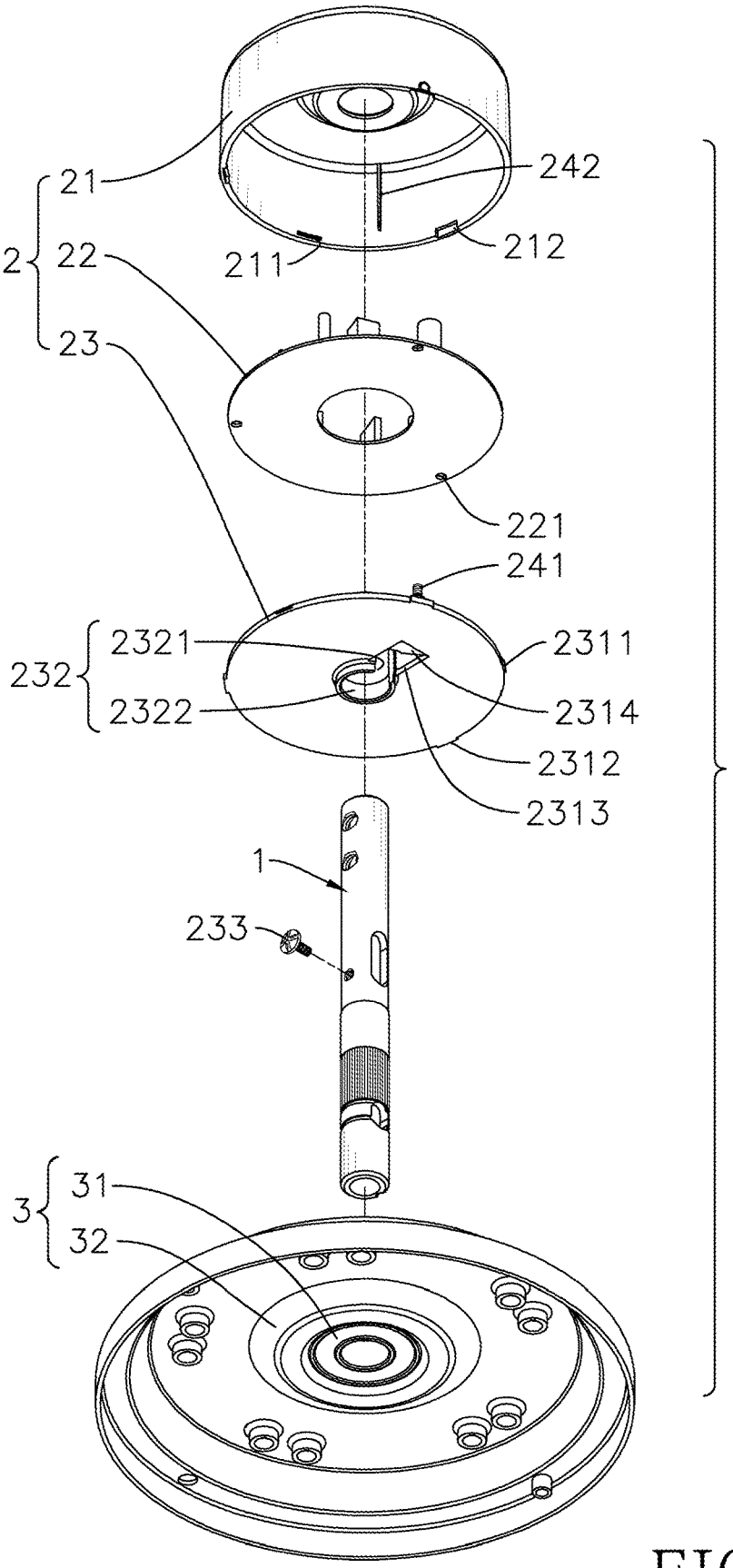
FIG. 2 is an exploded view of the assembling structure in FIG. 1, shown in a first view.
Figure 3:
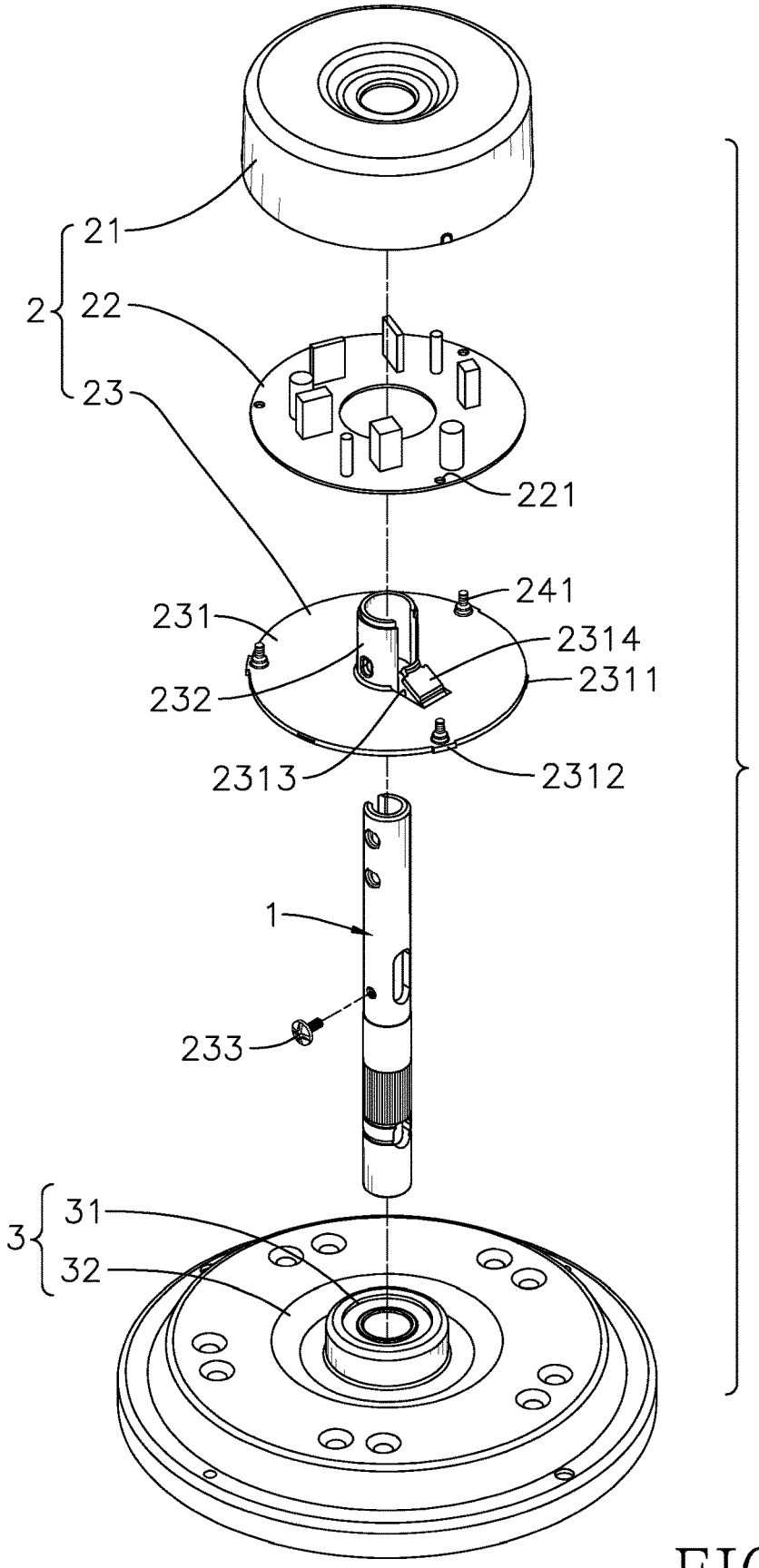
FIG. 3 is another exploded view of the assembling structure in FIG. 1 shown in a second view.
Figure 4:
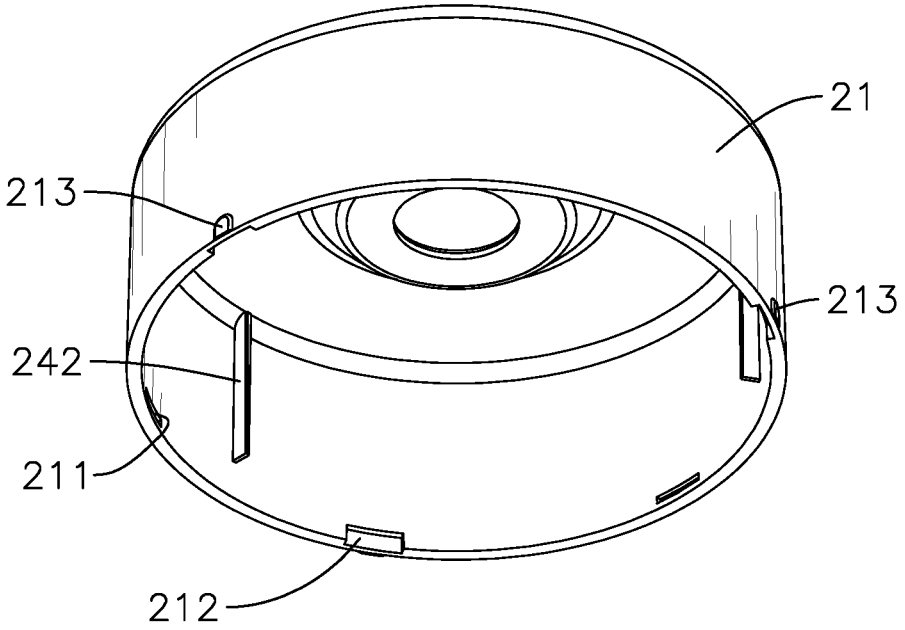
FIG. 4 is a perspective view of the assembling structure in FIG. 1 showing the upper cover.

In order to improve the mounting stability of a ceiling fan, the present invention provides an assembling structure of a ceiling fan. With reference to FIGS. 1 to 5, the assembling structure has a motor shaft 1 and a driving assembly 2. The motor shaft 1 is mounted through the driving assembly 2. The driving assembly 2 is mounted on the motor shaft 1. The motor shaft 1 and the driving assembly 2 can be assembled by a fixing unit such as a bolt, or be assembled with a buckling structure or by pasting.

Specifically, the driving assembly 2 has an upper cover 21, a circuit board 22, and a lower cover 23. The upper cover 21, the circuit board 22, and the lower cover 23 are sequentially assembled from top to bottom. The upper cover 21 and the lower cover 23 form and enclose a chamber to accommodate and protect the circuit board 22. The lower cover 23 has a covering board 231 and a mounting cylinder 232. The covering board 231 covers a bottom of the upper cover 21. The mounting cylinder 232 is mounted on a center of the covering board 231. The motor shaft 1 is mounted through the mounting cylinder 232 to mount the lower cover 23 on the motor shaft 1. The configuration of the mounting cylinder 232 increases the contact area of the lower cover 23 and the motor shaft 1, thereby enhancing the structural strength of the lower cover 23 and the motor shaft 1 and further improving the structure stability of the driving assembly 2 and the motor shaft 1. Thus, the present invention solves the noise issue caused by the loosened parts and the shaking generated by the fan blades, and having a simplified and reliable structure.

Moreover, the driving assembly 2 has a positioning mechanism 24 mounted in the chamber formed by the upper cover 21 and the lower cover 23. The positioning mechanism 24 limits the mounting position of the circuit board 22 in the chamber, so the circuit board 22 can be stably mounted in the chamber to further reduce the noises during operating, which offers a better user experience. The positioning mechanism 24 can be a positioning board, a positioning groove, or a positioning pillar, etc. The structure of the positioning mechanism 24 is not limited thereto, as the positioning mechanism 24 can be any structure that limits the mounting position of the circuit board 22.

The positioning mechanism 24 has a supporting pillar 241 protruding from a top surface of the covering board 231. The circuit board 22 has a supporting hole 221. The supporting pillar 241 matches and is mounted in the supporting hole 221 to make the circuit board 22 mounted on the supporting pillar 241. The supporting pillar 241 and the supporting hole 221 facilitate positioning and installation of the circuit board 22, prevent the circuit board 22 from moving horizontally in the chamber formed by the upper cover 21 and the lower cover 23, and ensure the mounting stability of the circuit board 22 in the chamber.

Preferably, the positioning mechanism 24 has a plurality of the supporting pillars 241 to further improve the mounting stability of the circuit board 22, thereby effectively preventing the noise during operation of the ceiling fan and providing a better user experience.

The positioning mechanism 24 has a supporting rib 242 mounted on an inner surface of the upper cover 21. A bottom end of the supporting rib 242 abuts a top surface of the circuit board 22. The configuration of the supporting rib 242 restricts the circuit board 22 to be mounted in a bottom of the chamber, and prevents the circuit board 22 from moving upward in the chamber formed by the upper cover 21 and the lower cover 23, which ensures the mounting stability of the circuit board 22 in the chamber. Additionally, the configuration of the supporting rib 242 also enhances the structural strength of the driving assembly 2.

Preferably, the positioning mechanism 24 has a plurality of the supporting ribs 242 to further improve the mounting stability of the circuit board 22, thereby effectively preventing the noise during operation of the ceiling fan and providing a better user experience.

A buckling groove 211 or a buckling protrusion 2311 are respectively formed on a lower segment of the inner surface of the upper cover 21 and an annular surface of the covering board 231. The buckling protrusion 2311 engages in the buckling groove 211 to assemble the upper cover 21 and the lower cover 23, and to prevent the upper cover 21 and the lower cover 23 from moving relative to each other, which loosens the structure of the driving assembly 2 and makes noise. In this embodiment, the buckling groove 211 is formed on the inner surface of the upper cover 21 and the buckling protrusion 2311 is formed on the annular surface of the covering board 231, but in other embodiments, the buckling groove 211 can be formed on the annular surface of the covering board 231 and the buckling protrusion 2311 can be formed on the inner surface of the upper cover 21.

A guiding groove 212 and a guiding protrusion 2312 are respectively formed on the lower segment of the inner surface of the upper cover 21 and the annular surface of the covering board 231. The guiding protrusion 2312 is mounted in the guiding groove 212 to assemble the upper cover 21 and the lower cover 23. The configuration of the guiding groove 212 and the guiding protrusion 2312 is a guide for assembly of the driving assembly 2, making the assembly process of the upper cover 21 and the lower cover 23 faster. In this embodiment, the guiding groove 212 is formed on the inner surface of the upper cover 21 and the guiding protrusion 2312 is formed on the annular surface of the covering board 231, but in other embodiments, the guiding groove 212 can be formed on the annular surface of the covering board 231 and the guiding protrusion 2312 can be formed on the inner surface of the upper cover 21.

A marking protrusion 213 is formed on a lower segment of an outer surface of the upper cover 21. The marking protrusion 213 corresponds in position to the guiding groove 212 (or the guiding protrusion) formed on the lower segment of the inner surface of the upper cover 21. In this embodiment, with reference to FIG. 4, the marking protrusion 213 is formed on the lower segment of the outer surface of the upper cover 21 and corresponds in position to the guiding groove 212, so that an operator can quickly find the guiding groove 212 to match the guiding protrusion 2312, thereby making the assembling process of the upper cover 21 and the lower cover 23 faster.

The mounting cylinder 232 has a mounting segment 2321 and a shifting segment 2322 formed integrally to ensure the structural strength of the lower cover 23. The mounting segment 2321 is located on the top surface of the covering board 231. The shifting segment 2322 protrudes from a bottom of the covering board 231 to provide an adequate cooling space for the driving assembly 2 to prevent the circuit board 22 from damage.

The upper cover 21 is in a bowl shape with an opening downward. A stepped surface is formed on a top of an outer annular surface of the mounting segment 2321. An inner top segment of the upper cover 21 abuts the stepped surface of the mounting cylinder 232. A bottom of the upper cover 21 abuts the top surface of the covering board 231. This configuration makes the upper cover 21 and the lower cover 23 matched and connected to prevent the upper cover 21 and the lower cover 23 from moving with respect to each other, and supports and maintains the chamber formed by the upper cover 21 and the lower cover 23 to protect the circuit board 22 in the chamber.

The lower cover 23 has a fixing unit 233 sequentially mounted through the mounting segment 2321 and the motor shaft 1 to fix the lower cover 23 on the motor shaft 1, which is simple in structure and easy to assemble. The fixing unit 233 can be a bolt or a screw, but is not limited thereto, as the fixing unit 233 can be any component that is used to fix two parts.

The covering board 231 has a cable groove 2313 and a covering unit 2314. The covering unit 2314 covers or uncovers the cable groove 2313. Since a cable is usually mounted in the motor shaft 1 and passes through a middle hole of the motor shaft 1 to connect the circuit board in the chamber when installing a ceiling fan, in order to simplify the assembling process of the driving assembly 2, the covering board 231 comprises the cable groove 2313 and the covering unit 2314. When mounting the lower cover 23 on the motor shaft 1, the operator first opens the cable groove 2313 by switching the covering unit 2314. Then, the cable passing through the middle hole is mounted in the cable groove 2313, and the lower cover 23 is mounted below the middle hole. Finally, the covering unit 2314 is switched to cover the cable groove 2313 to block dust or insects from entering the driving assembly 2 and affecting operation.

The assembling process of the assembling structure of a ceiling fan is described below:

1. Switch the covering unit 2314 to open the cable groove 2313, and mount the cable passing through the middle hole of the motor shaft 1 in the cable groove 2313.
2. Fix the lower cover 23 on the motor shaft 1 by the fixing unit 233.
3. Switch the covering unit 2314 again to close the cable groove 2313.
4. Mount the motor shaft 1 through the circuit board 22, and mount the circuit board 22 on the top of the covering board 231.
5. Mount the motor shaft 1 through the upper cover 21, and mount the upper cover 21 on the top of the lower cover 23.

The present invention further provides a ceiling fan having the abovementioned assembling structure and a rotating assembly 3. The rotating assembly 3 is rotatably mounted on the motor shaft 1 and located below the assembling structure. A bottom of the shifting segment 2322 abuts a top of the rotating assembly 3. This configuration provides an adequate cooling space for the driving assembly 2 to prevent the circuit board 22 from damage, and provides an adequate rotating space for the rotating assembly 3 to prevent the driving assembly 2 and the rotating assembly 3 from interfering with each other and affecting operation.

Figure 5:
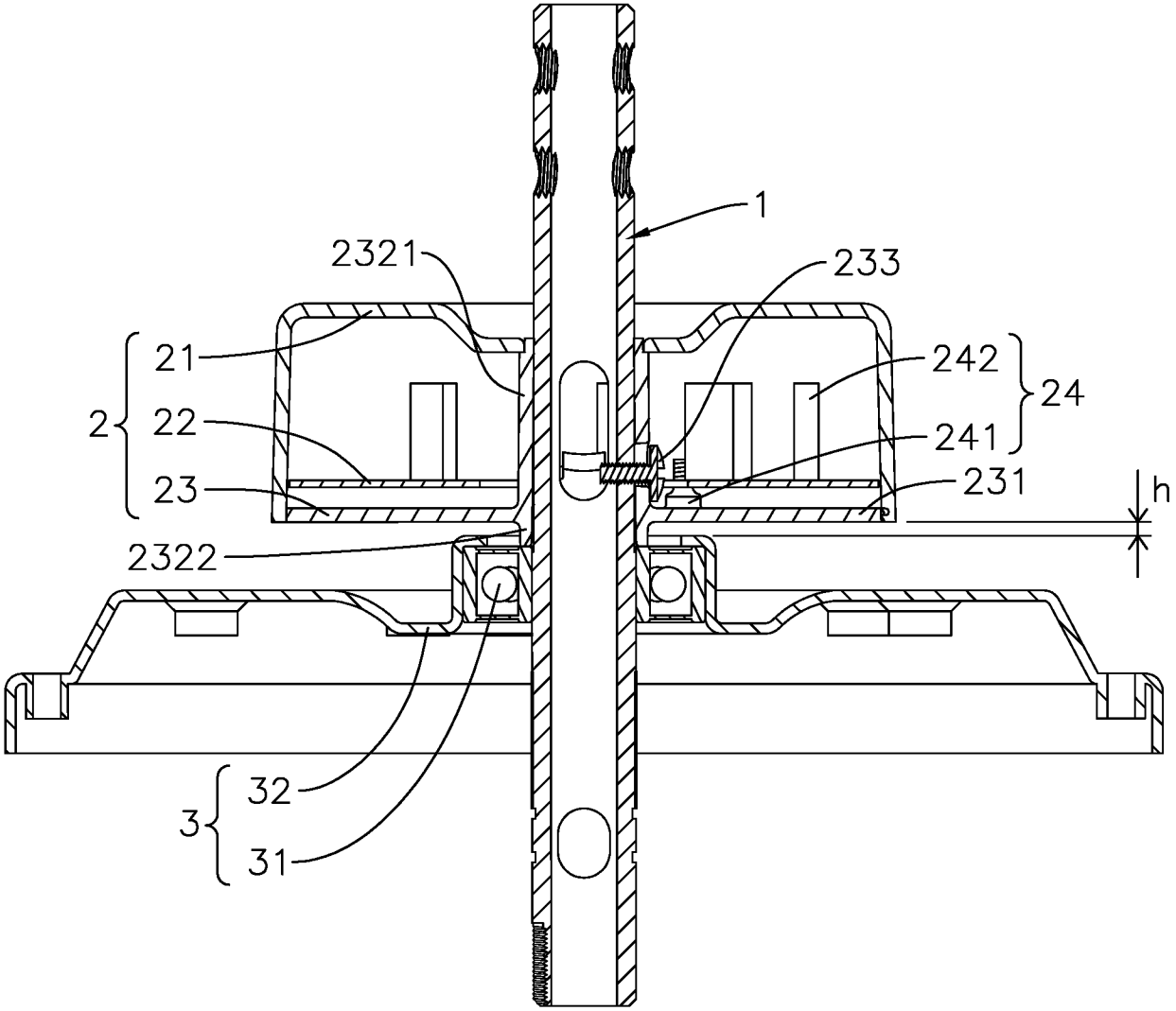
FIG. 5 is a side view in cross section of the assembling structure in FIG. 1.

The rotating assembly 3 has a bearing 31 and a rotating shell 32. The bearing 31 is mounted on the motor shaft 1. The rotating shell 32 rotates around the motor shaft 1 via the bearing 31. This configuration is simple in structure and reliable in performance. A gap is formed between the rotating shell 32 and the covering board 231. With reference to FIG. 5, a width of the gap, labeled as "h", is more than or equal to 3 millimeters. The gap ensures an adequate rotating space for the rotating assembly 3, and prevents the driving assembly 2 and the rotating assembly 3 from interfering with each other to improve structural stability of the ceiling fan.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An assembling structure of a ceiling fan; the assembling structure configured to mount with a rotating assembly and the assembling structure comprising:

a motor shaft; and a driving assembly mounted securely on the motor shaft and disposed above the rotating assembly: the motor shaft mounted through the driving assembly; the driving assembly having an upper cover;

a lower cover disposed below the upper cover and having a covering board; and a mounting cylinder integrally formed in a center of the covering board; the lower cover mounted on the motor shaft via the mounting cylinder;

a chamber formed between the upper cover and the lower cover;

a circuit board mounted in the chamber; the upper cover, the lower cover, and the circuit board sequentially arranged from top to bottom; and a positioning mechanism mounted in the chamber and limiting a mounting position of the circuit board.

2. The assembling structure of a ceiling fan as claimed in claim 1, wherein the circuit board has a supporting hole; and the positioning mechanism has a supporting pillar protruding from a top surface of the covering board and mounted in the supporting hole.

3. The assembling structure of a ceiling fan as claimed in claim 2, wherein the positioning mechanism has a supporting rib mounted on an inner surface of the upper cover; a bottom end of the supporting rib abutting the top surface of the covering board.

4. The assembling structure of a ceiling fan as claimed in claim 3, wherein the driving assembly has a buckling groove; and a buckling protrusion engaged in the buckling groove; the buckling groove and the buckling protrusion respectively disposed on a lower segment of the inner surface of the upper cover and an annular surface of the covering board.

5. The assembling structure of a ceiling fan as claimed in claim 4, wherein the driving assembly has a guiding groove;

a guiding protrusion mounted in the guiding groove; the guiding groove and the guiding protrusion respectively mounted on a lower segment of the inner surface of the upper cover and the annular surface of the covering board; and a marking protrusion mounted on a lower segment of an outer surface of the upper cover and corresponding in position to the guiding groove or the guiding protrusion mounted on the lower segment of the inner surface of the upper cover.

6. The assembling structure of a ceiling fan as claimed in claim 5, wherein the mounting cylinder has a mounting segment located on the top surface of the covering board;

a shifting segment formed integrally with the mounting segment and protruding out of a bottom surface of the covering board; and a stepped surface formed on a top of an outer annular surface of the mounting segment;

the upper cover is in a bowl shape with an opening downward; an inner top segment of the upper cover abuts the stepped surface of the mounting cylinder; a bottom of the upper cover abuts the top surface of the covering board.

7. The assembling structure of a ceiling fan as claimed in claim 6, wherein the lower cover has a fixing unit sequentially mounted through the mounting segment and the motor shaft; the lower cover mounted on the motor shaft via the fixing unit.

8. The assembling structure of a ceiling fan as claimed in claim 7, wherein the covering board has a cable groove; and a covering unit selectively covering and closing the cable groove.

9. The assembling structure of a ceiling fan as claimed in claim 1, wherein the positioning mechanism has a supporting rib mounted on an inner surface of the upper cover; a bottom end of the supporting rib abutting a top surface of the covering board.

10. The assembling structure of a ceiling fan as claimed in claim 1, wherein the driving assembly has a buckling groove; and a buckling protrusion engaged in the buckling groove; the buckling groove and the buckling protrusion respectively disposed on a lower segment of an inner surface of the upper cover and an annular surface of the covering board.

11. The assembling structure of a ceiling fan as claimed in claim 1, wherein the driving assembly has a guiding groove;

a guiding protrusion mounted in the guiding groove; the guiding groove and the guiding protrusion respectively mounted on a lower segment of an inner surface of the upper cover and an annular surface of the covering board; and a marking protrusion mounted on a lower segment of an outer surface of the upper cover and corresponding in position to the guiding groove or the guiding protrusion mounted on the lower segment of the inner surface of the upper cover.

12. The assembling structure of a ceiling fan as claimed in claim 1, wherein the mounting cylinder has a mounting segment located on a top surface of the covering board;

a shifting segment formed integrally with the mounting segment and protruding out of a bottom surface of the covering board; and a stepped surface formed on a top of an outer annular surface of the mounting segment;

the upper cover is in a bowl shape with an opening downward; an inner top segment of the upper cover abuts the stepped surface of the mounting cylinder; a bottom of the upper cover abuts the top surface of the covering board.

13. The assembling structure of a ceiling fan as claimed in claim 12, wherein the lower cover has a fixing unit sequentially mounted through the mounting segment and the motor shaft; the lower cover mounted on the motor shaft via the fixing unit.

14. The assembling structure of a ceiling fan as claimed in claim 1, wherein the covering board has a cable groove; and a covering unit selectively covering and closing the cable groove.

15. A ceiling fan comprising:

an assembling structure having a motor shaft; and a driving assembly mounted securely on the motor shaft; the motor shaft mounted through the driving assembly; the driving assembly having a lower cover disposed below the upper cover and having a covering board; and a mounting cylinder integrally formed in a center of the covering board; the lower cover mounted on the motor shaft via the mounting cylinder; the mounting cylinder having a mounting segment located on a top surface of the covering board;

a shifting segment formed integrally with the mounting segment and protruding out of a bottom surface of the covering board; and a stepped surface formed on a top of an outer annular surface of the mounting segment;

an upper cover being in a bowl shape with an opening downward; an inner top segment of the upper cover abutting the stepped surface of the mounting cylinder; a bottom of the upper cover abutting the top surface of the covering board;

a chamber formed between the upper cover and the lower cover;

a circuit board mounted in the chamber; the upper cover, the lower cover, and the circuit board sequentially arranged from top to bottom; and a positioning mechanism mounted in the chamber and limiting a mounting position of the circuit board;

a rotating assembly rotatably mounted on the motor shaft and located below the driving assembly; a bottom of the shifting segment abutting a top of the rotating assembly.

16. The ceiling fan as claimed in claim 15, wherein the rotating assembly has a bearing mounted on the motor shaft; and a rotating shell being rotatable around the motor shaft via the bearing; a gap formed between the rotating shell and the covering board; a width of the gap being more than or equal to 3 millimeters.

* * * * *